US005584100A

United States Patent [19]

Doyle et al.

[11] Patent Number: 5,584,100

[45] Date of Patent: Dec. 17, 1996

[54] HINGE

[76] Inventors: David Doyle, 21/40B Barry Street, Neutral Bay New South Wales 2089; Neil Dunne, 5/19-23 Cairo Street, Cammeray New South Wales 2062; Mark Cumming, 22 Crestwood Avenue, Niagara Park New South Wales 2250, all of Australia

[21] Appl. No.: 190,024

[22] PCT Filed: Jul. 29, 1992

[86] PCT No.: PCT/AU92/00392

§ 371 Date: Jan. 28, 1994

§ 102(e) Date: Jan. 28, 1994

[87] PCT Pub. No.: WO93/03249

PCT Pub. Date: Feb. 18, 1993

[30] Foreign Application Priority Data

Jul. 29, 1991 [AU] Australia ..... PK7474

[51] Int. Cl.[6] ..... E05F 1/08

[52] U.S. Cl. ..... 16/301; 16/300; 16/299

[58] Field of Search ..... 16/298–301

[56] References Cited

U.S. PATENT DOCUMENTS

| | | | |
|---|---|---|---|
| 29,212 | 7/1860 | Acker | 16/298 |
| 3,316,582 | 5/1967 | Johnston et al. | 16/52 |
| 3,825,973 | 7/1974 | Gwozdz | 16/301 |
| 3,965,533 | 6/1976 | Frohlich | 16/301 |
| 4,073,038 | 2/1978 | Curry et al. | 16/301 |
| 4,583,262 | 4/1986 | Werner | 16/301 |
| 4,751,765 | 6/1988 | Wu | 16/301 |
| 4,817,242 | 4/1989 | Rapp | 16/300 |

FOREIGN PATENT DOCUMENTS

| | | | |
|---|---|---|---|
| 63251/60 | 5/1963 | Australia . | |
| 1961736 | 6/1971 | Germany . | |
| 29217 | 9/1931 | United Kingdom | 16/301 |
| 759211 | 10/1956 | United Kingdom . | |
| 1382227 | 1/1975 | United Kingdom . | |

*Primary Examiner*—M. Rachuba
*Assistant Examiner*—Donald M. Gurley
*Attorney, Agent, or Firm*—Davis and Bujold

[57] ABSTRACT

The hinge comprises a first hinge member (11) and a second hinge member (12). The first hinge member comprises a cylindrical housing (16) having first and second open ends (17 and 18 respectively). The cylindrical housing (16) is located between flange members (26 and 27) of the second hinge member (12). A torsion spring (20) is provided inside the cylindrical housing (16) and one end (21) fits into a recess (22) at end (18) of the cylindrical housing (16) and the other end fits into a recess (36) in a coupling element (30) which is located at the other end (17) of the cylindrical housing (16). The coupling element (30) has a hexagonal engagement surface (39) which engages a matching engagement surface in flange (27). By depressing the coupling element (30) so that it is no longer in engagement with flange member (27), the coupling element (30) can be turned so that its hexagonal external surface (39) is in a different orientation with respect to the matching hexagonal surface of the flange (27), when pressure on the coupling element is released.

6 Claims, 4 Drawing Sheets

HINGE

This invention relates to a hinge and in particular, a hinge which is biased into either an open or a closed position.

Hinges of the above type are used in many applications. Self closing hinges are often required by law to be employed in safety pool fences to form part of a self closing mechanism for the pool gate. Applications for self opening hinges include access doorways and doors in public toilets.

A typical self closing hinge comprises first and second hinge members formed from pressed metal. A hinge pin interconnects the first and second members and the members are pivotal about the hinge pin such that they are movable between an open and closed position. A helical spring is located around the hinge pin and is connected directly to the first and second hinge members. This helical spring acts as a torsion spring to bias the members into either the open or closed positions.

The problem with the above type of hinge is that adjustment of the torsion acting on the members is often not possible without replacing the spring. In some cases very limited adjustment is possible through tightening of a grub screw located in one of the housings, but in the past this type of adjustment has been found to be ineffective. Furthermore, as the parts of the hinge are made from metal, the performance characteristics of the hinge in the long term can diminish as the parts are susceptible to corrosion.

The aim of the present invention is to provide a hinge which, in at least a preferred embodiment, ameliorates many of the problems of the prior art and provides a hinge which is economic to manufacture yet has improved performance characteristics.

Accordingly, the present invention provides a hinge comprising first and second hinge members coupled together by coupling means to be pivotably movable between an open and a closed position, and a torsion spring having a first end connected to the first hinge member and a second end connected to the coupling means, the coupling means being further arranged to translate torque from the torsion spring to the second hinge member such that the torsion spring biases said hinge members into either the open or the closed position.

By connecting one end of the torsion spring directly to the coupling means, which in turn translates the torsion to the second hinge member, the applicant has found that it enables much greater freedom in the design of the hinge. With this arrangement the coupling member can be arranged to be movable relative to the hinge member to enable adjustment of the torsion acting on the hinge member without the need to replace the spring. Furthermore, it enables the hinge member and the coupling means to be made from plastics material such as a glass reinforced nylon. With this arrangement, all the bearing surfaces within the hinge can be made from the plastics material. This has the benefit that bearings are generally stronger than the bearings formed from the pressed metal members and are less likely to deform out of shape and as such the performance characteristics of the hinge will not diminish in the long term.

In a preferred embodiment, the coupling means includes a coupling element to which the second end of the torsion spring is connected, the coupling element being rotatable relative to the hinge members between a plurality of first positions, wherein rotation of the coupling element between the first positions varies the torque from the torsion spring acting on the coupling element such that there is a predetermined torque level corresponding to each first position and wherein in each first position, the coupling element translates its corresponding torque from the torsion spring to the second hinge member.

Preferably the coupling element is movable to a second position wherein it is free to rotate relative to the hinge members. In this second position the coupling element is able to move between the first positions.

In a preferred embodiment the torsion spring is in the form of a helical spring and the coupling element is biased into the first position by the helical spring. In this arrangement to move the coupling element to the second position it is necessary to compress the helical spring.

Preferably the first hinge incorporates a cylindrical housing having a first and a second end and in which the torsion spring is arranged to be located. In this arrangement the second hinge member incorporates parallel spaced flanges which are arranged to be located over the first and second ends of the housing. Preferably the coupling means comprises a first coupling element which couples the first flange to the first end of the housing and a second coupling element which is arranged to couple the second end of the housing to the second flange.

One preferred form of the invention will now be described by way of example only with reference to the accompanying drawings in which.

Figure 1:
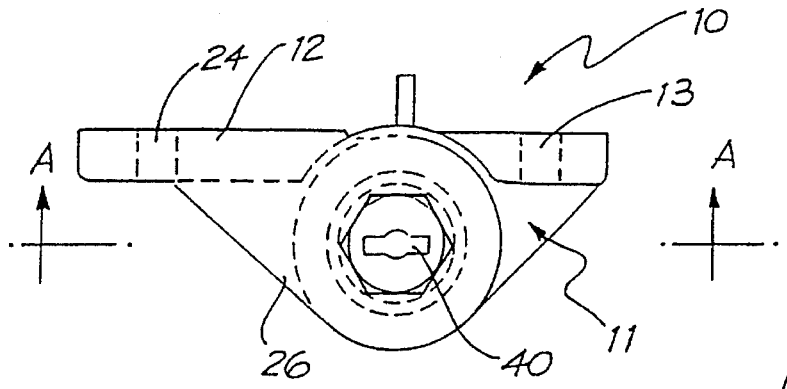
FIG. 1 is a top view of the hinge embodying the present invention in a closed position.
Figure 2:
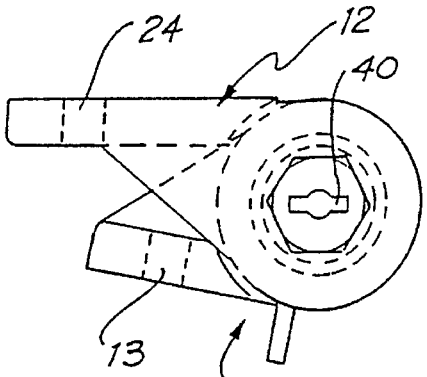
FIG. 2 is the hinge of FIG. 1 in an open position.
Figure 3:
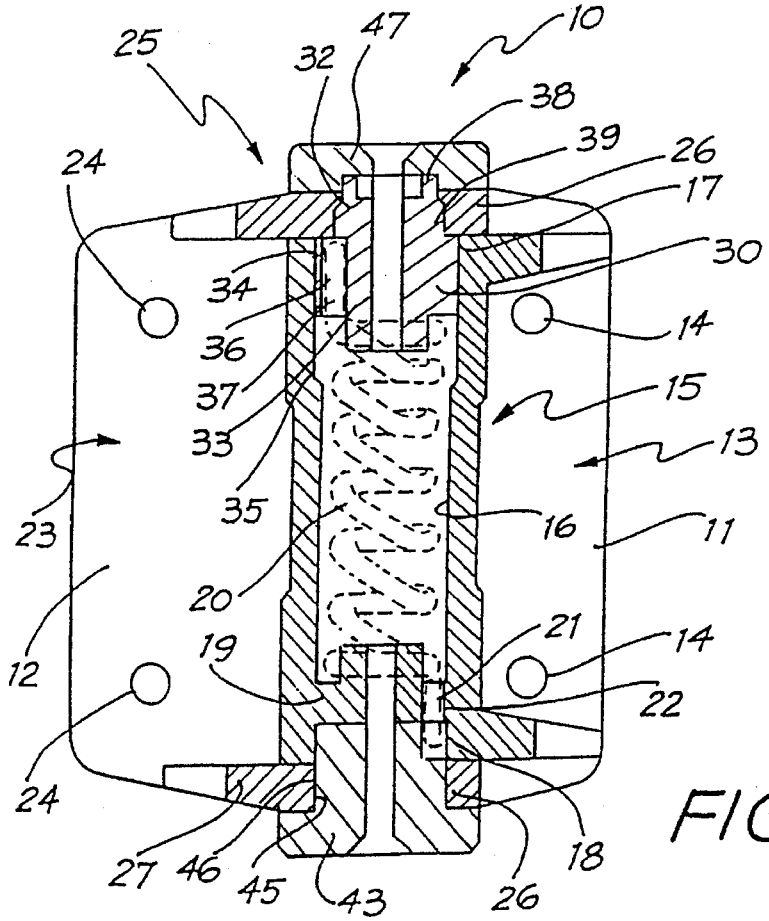
FIG. 3 is a sectional plan view of the hinge of FIG. 1 along section line A—A.

As illustrated in FIGS. 1 to 3, a hinge 10 is disclosed comprising hinge members 11 and 12 which are typically made from moulded glass reinforced nylon. The first hinge member 11 comprises an outer portion 13 arranged to be secured to a structure (not shown) such as a door frame or a gate post through apertures 14. The first hinge member further includes an inner portion 15 which comprises a cylindrical housing 16 having first and second open ends (17 and 18 respectively). A seat 19 is located within the housing 16 adjacent the second end 18.

A helical steel spring 20 (shown in phantom) is arranged to be located within the housing 16 and has a first end 21 which is arranged to be keyed to the seat 19 through recess 22. In this way, the first end 21 of the spring 20 is secured relative to the first hinge member 11.

The second hinge member incorporates an outer portion 23 which is similar in construction to the outer portion 13 of the first member 11. The outer portion 23 includes apertures 24 which are arranged to connect the second hinge member 12 to a door or gate (not shown). The second hinge member 12 further incorporates an inner portion 25 comprising two spaced flange members 26 and 27. The flange members are arranged to be located over the first and second ends (17 and 18) of the housing and both the flange members incorporate apertures 28 (FIG. 4) and 29 which communicate with the respective ends (17 and 18) of the cylindrical housing 16.

First and second coupling elements 30 and 43 are arranged to couple the first hinge member 11 to the second hinge member 12 in a manner which enables the flange member 26 and 27 to pivot about the housing 16 such that they are movable from a closed position as shown in FIG. 1 to an open position as shown in FIG. 2.

The first coupling element 30 incorporates a head portion 32 and a body portion 33. In a first position as shown in FIG. 3, the head portion 32 is arranged to be located in the aperture 28 of the flange 26 with the body portion 33 located within the housing 16. As will be further explained below, in the first position, the first coupling element 30 is secured relative to the flange member 26 by virtue of the engagement of the head portion 32 within the aperture 28 such that the second hinge member 12 is caused to rotate about the housing 16 with rotation of the first coupling element 30.

In contrast, the outer wall surface 34 of the body portion 33 is arranged to slidingly engage the inner wall surface 35 of the housing 16. In this way, the outer wall surface 34 of the body portion cooperates with the inner wall surface 35 of the housing to provide one of the bearing surfaces about which the first hinge member 11 moves relative to the second hinge member 12 between the open and the closed positions.

In addition, the body portion 33 of the first coupling element 30 incorporates a recess 36 into which the second end 37 of the spring 20 is arranged to be keyed. In this way, the spring 20 is securely connected to the first coupling element 30.

Figure 5:
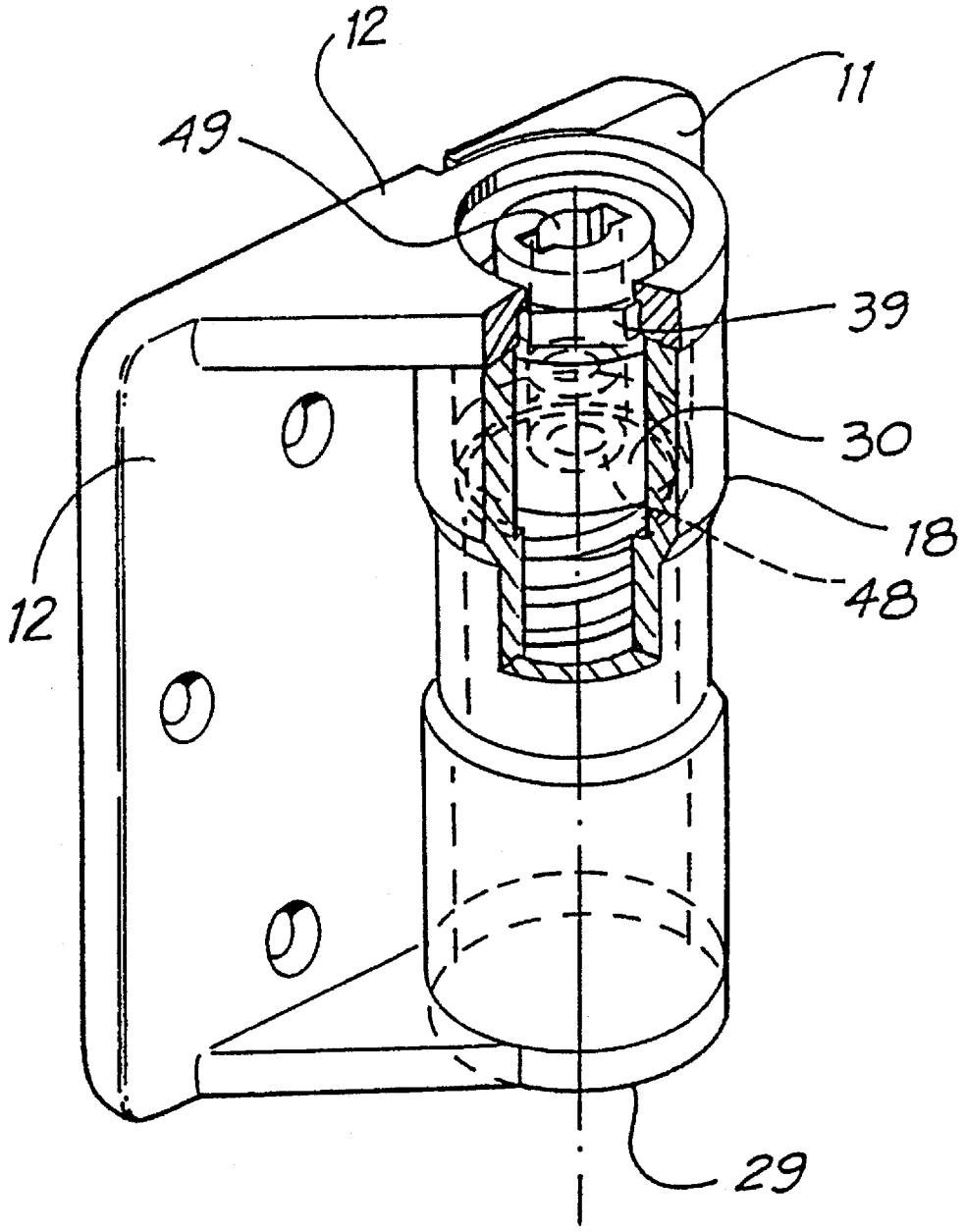
FIG. 5 is an angled view of the embodiment shown in FIGS. 1 to 4, with the cylindrical housing shown partly cut away.

As indicated above, in the first position, the head portion 32 of the first coupling element 30 is arranged to engage the aperture 28. As shown in FIG. 5 the head portion of the first coupling element incorporates two sections, namely a top section 38 which is a circular cross section and an intermediate section 39 which is hexagonal in cross section. The top and intermediate sections are sized such that the diameter of the circular top section 38 is the same as the minor axis of the hexagonal intermediate section 39. Furthermore, the top section 38 incorporates a slot 40 suitable for accommodating a screw driver (not shown).

The aperture 28 is shaped to correspond with the top section 38 and intermediate section 39 of the head portion and as such incorporates a corresponding circular shaped portion 41 and hexagonally shaped portion 42.

When in the first position, the head portion is arranged such that the top section 38 is located in the corresponding circular shaped part 41 of the aperture 28 and the intermediate section 39 is located in the corresponding hexagonal shaped portion 42 of the aperture 28. With this arrangement the second hinge member 12 and the first coupling element 30 are coupled together and rotate together about the housing 16.

Figure 4:
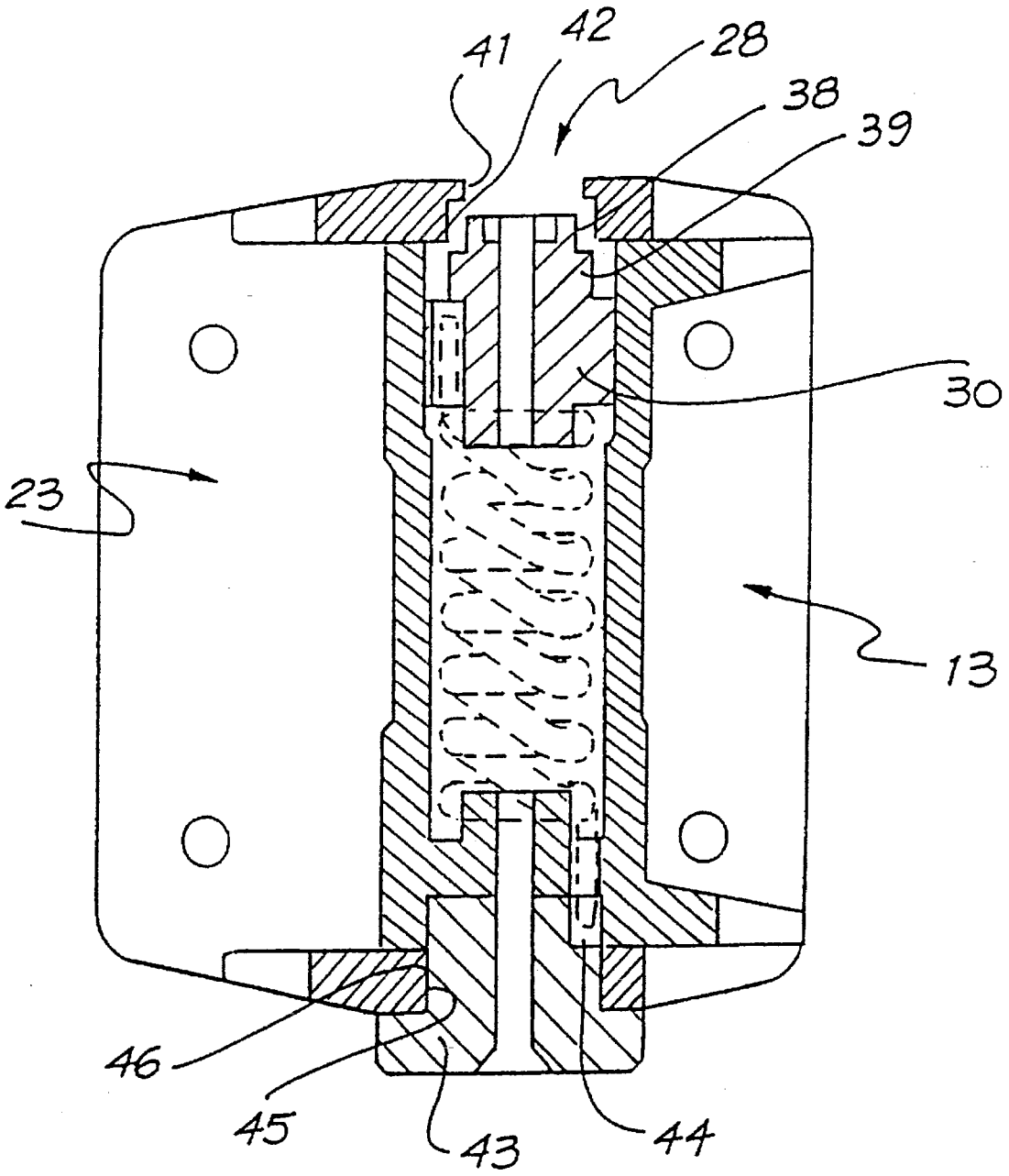
FIG. 4 is the sectional view of FIG. 3 with the cap removed and the first coupling element in the second position.

The first coupling element 30 is movable along the axis of the housing to a second position as shown in FIG. 4. To move from the first to the second position it is necessary to compress the spring 20. Once in the second position, the intermediate section 39 of the first coupling element 30 is no longer located within the hexagonally shaped portion 42 of the aperture 28. As a consequence the first coupling element 30 is uncoupled from the second hinge member 12 and is able to rotate relative to both the first and second hinge members within the housing 16.

Furthermore, as the intermediate portion is hexagonally shaped, when in the second position, the first coupling element 30 can be rotated relative to the second hinge member and in one 360° revolution, there will be six different positions wherein the hexagonally shaped intermediate section 39 will align with the hexagonally shaped portion 42 of the aperture 28.

The second coupling element 43 extends through the aperture 29 and into the second end 18 of the housing 16. In contrast to the first coupling element 30, the second coupling element 43 is secured relative to the housing 16 but is rotatable relative to the second hinge member 12.

The second coupling element 43 is secured relative to the housing 16 by being bolted to the seat 19. Typically a bolt (not shown) passes through the second coupling element 43 and engages with a corresponding thread or nut (not shown) formed in the seat 19. To further assist in securing the second coupling element 43 to the seat 19, the second coupling element incorporates a recess 44 which cooperates with the recess 22 located in the seat 19 and is arranged to receive the end portion of the first end 21 of the spring 20. This effectively keys the second coupling element 43 to the seat 19.

With the arrangement of the second coupling element, the wall surface 45 of the second coupling element 43 cooperates with the internal surface 46 of the aperture 29 to provide the other of the bearing surfaces about which the hinge members 11 and 12 rotate from the open to the closed position.

A cap 47 is located on the top of the first flange member 26 and is removably mounted to the first coupling element 30. A brass insert 48 is provided in the lower end of the coupling element 30 and is aligned with a central bore 49 extending through the coupling element 30. The brass insert is a cylindrical tube having an internal thread which is arranged to receive a screw for connecting the cap 47 to the coupling element 30 (see FIG. 5). This cap 47 covers the head portion 32 of the first coupling element and is shaped to have the same profile as that of the second coupling element.

The hinge is arranged to operate as follows:

Depending on whether the hinge 10 is to be a self opening or self closing hinge, a suitable helical spring 20 (ie. left or right hand wound) is chosen. To assemble the various elements of the hinge together, it is merely necessary to locate the spring 20 in the housing 16 with its first end 21 in the recess 22. The first coupling element 30 is then connected to the second end of the spring and is forced against the spring to be located wholly within the housing 16. The second hinge member 12 is then positioned such that the flange members (26,27) are located over the ends (17,18) of the housing with the apertures (28,29) in the flanges aligned with ends (17,18) of the housing. At this position the first coupling element 30 is able to move from being in a position wholly within the housing 16, to a position wherein its head portion 32 engages the aperture 28 in the first position. The second coupling element 43 is then secured to the seat 19 and the cap 47 secured to the first coupling element 43. The hinge 10 is now fully assembled.

The spring acts as a torsion spring and as such resists the motion of its first end 21 relative to its second end 37. As the first end is connected to the housing 16 through the seat 19 and the second end 37 is connected to the first coupling element 30, the spring 20 biases the first coupling element 30 into a predetermined position relative to the housing 16. However, when in the first position, the first coupling element 30 is coupled relative to the second hinge member 12 and as such the torque force of the spring 20 is translated to the second hinge member 12. In this way, the spring 20 biases the hinge members (11,12) into a predetermined position and the hinge is arranged that this position will correspond to either the open or the closed position.

Furthermore, the actual torque acting on the hinge members (11,12) can be varied by rotation of the first coupling element 30 relative to the first and second flange member. This is achieved by forcing the first coupling element 30 to the second position, against the resistive force generated by compression of the spring 20. Once in the second position the first coupling element 30 is uncoupled from the second hinge member and is able to be rotated relative to both the first and second hinge members.

To enable the first coupling element 30 to locate into the first position it is necessary that the hexagonally shaped intermediate section 39 is aligned to the hexagonally shaped portion 42 of the aperture 28 and in the rotation of the first coupling element through 360°, the head portion 32 will align in six different positions with the hexagonally shaped portion 42 of the aperture 28 and furthermore, at each different aligned position, the torque acting from the spring on the first coupling element 30 will be different from the torque generated when the first coupling element 30 is in any other of the aligned positions.

Once in any one of these aligned positions, the first coupling element can be moved into the first position wherein the torque force corresponding to that aligned position is translated to the second hinge member 12.

Consequently, the hinge enables the torque force acting on the hinge members to bias the hinge member 12 into either the open or closed position to be varied. Furthermore, with the arrangement of the coupling elements, all the bearing surfaces can be formed from structural plastics material and furthermore the actual bearing surface is greatly enlarged as compared to a typical hinge using a hinge pin.

Furthermore, as the coupling elements and the hinge members can be all formed from structural plastics and as the assembly of the hinge is very simple, the hinge arrangement can be economically manufactured and the applicant has found that the cost of manufacture is approximately half that as compared to prior art hinge arrangements incorporating a metal hinge pin and pressed metal hinge members.

Figure 6:
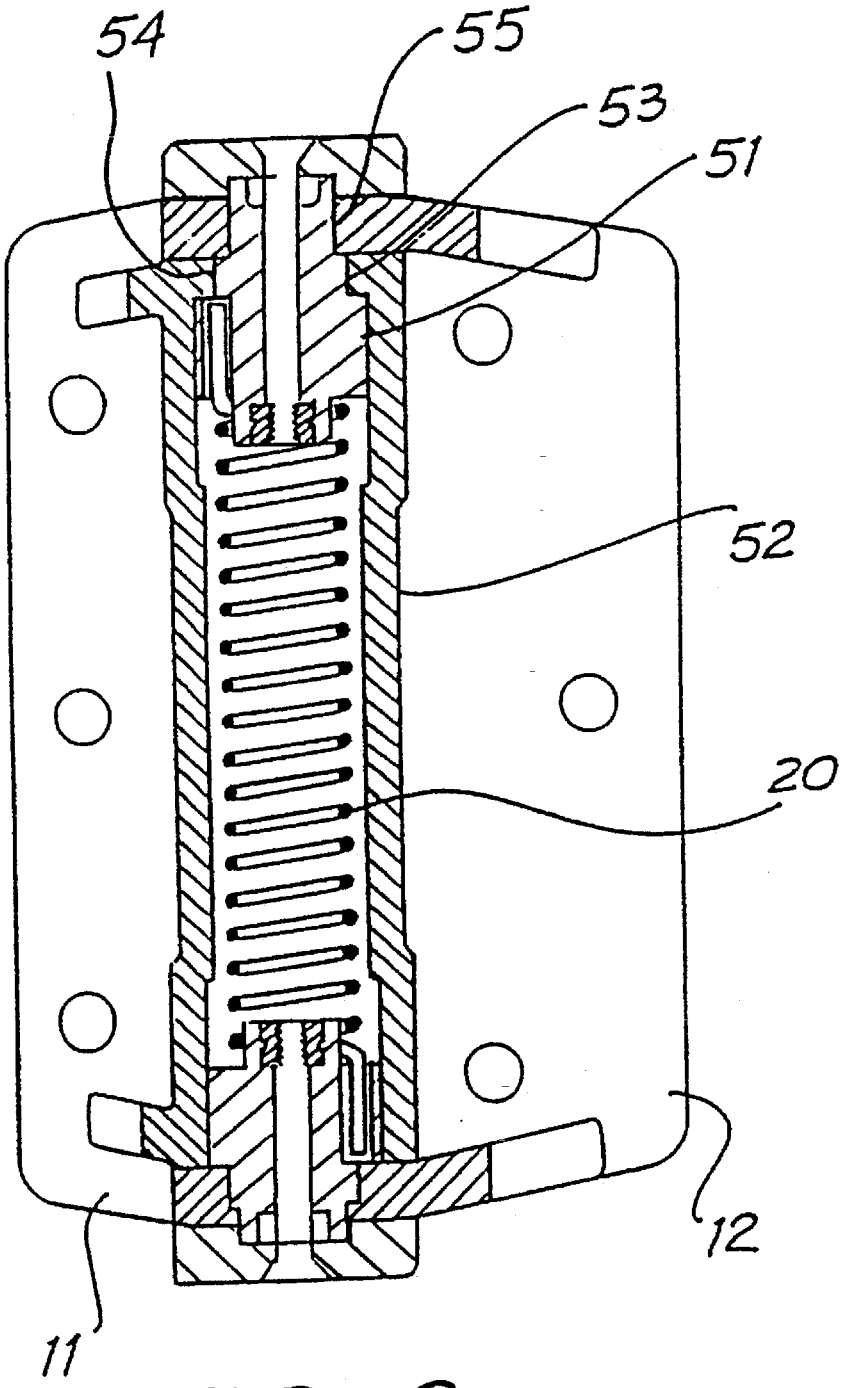
FIG. 6 shows a second embodiment of the present invention in a sectional plan view.

As shown in FIG. 6, a second embodiment of the present invention incorporates two coupling elements 50, 51 at either end of a cylindrical housing 52 which is effectively the same as cylindrical housing 18 in the first embodiment. The coupling elements 50 and 51 are substantially identical to the coupling element 30 and operate in a similar fashion. The advantage of having two coupling elements one at each end of the cylindrical housing 52, can be explained as follows. In the first embodiment it is only possible to adjust the bias of the torsion spring 20 by inserting a screw driver into the recess 40 and depressing the coupling element 30 so that the engaging hexagonal surfaces of the intermediate section 39 and hexagonally shaped portion 42 are disengaged. By turing the screw driver, the coupling element 30 is also turned about its central longitudinal axis, thus, its orientation is changed. Thus, by releasing pressure on the coupling element 30, its intermediate section 39 will again engage the hexagonally shaped portion 42. But, because the torque applied by the torsion spring will now be different, the result will be that the torsion spring 20 will bias the second hinge member 12 in a different position with respect to the first hinge member 11.

By having coupling elements at both ends of the cylindrical housing 52, the bias supplied by the torsion spring 20 can be changed at either end of the cylindrical housing 52.

It should also be noted that in the second embodiment, the coupling element 51 does not actually have its intermediate section 53 (corresponding to intermediate section 39 in FIGS. 1 to 4) shaped to match that of the internal surface of the flange 55 of the second hinge member (corresponding to flange 26 in the first embodiment). Instead, the intermediate section 53 has its external surface shaped to engage a matching shaped surface 54 of the first hinge member. This ensures that one end of the torsion spring is connected to the first hinge member 11 and the other end is connected to the second hinge member 12.

What is claimed is:

1. A hinge, comprising a first hinge element including a hollow cylindrical housing having longitudinal central axis and a hinge body portion having means for securing said first hinge element to a structure, a second hinge element including first and second spaced apart end pieces receiving the cylindrical housing of the first hinge element therebetween, and a hinge body portion arranged to be secured to a second structure, biasing means being located within the cylindrical housing and coupling the first hinge element to a coupling element, said coupling element having a first portion received within one end of the cylindrical housing and having a cylindrical bearing surface bearing against an inner wall of the cylindrical housing, whereby the biasing means is arranged to restrain relative rotation of the coupling element with respect to the first hinge element about said central axis, the coupling element further including a second portion having a first engagement surface means being received within an aperture provided in the first end piece of the second hinge element, said aperture having a correspondingly shaped mating engagement surface means for preventing relative between said second hinge element and said coupling element, the biasing means also resiliently biasing the coupling element in a direction axially outwardly of the cylindrical housing along said central axis urging the second portion to engage with the aperture of the first end piece so that when the second hinge element is pivoted with respect to the first hinge element the coupling element rotates with the second hinge element and the bearing surface of the first portion rotates against the inner wall of the cylindrical housing.

2. A hinge in accordance with claim 1, wherein the engagement surface means of the coupling element is disengageable from the corresponding mating engagement surface means of the first end of the second hinge element by moving the coupling element against the bias of the biasing means axially inwardly along the central axis towards the cylindrical housing and torsion applied by the biasing means between the first and second hinge elements, via the coupling element, may be adjusted by rotating the engagement surface means relative to each other and subsequently releasing the coupling element to cause the engagement surface means to re-engage in a new relative orientation.

3. A hinge in accordance with claim 1, wherein the biasing means is a torsion spring.

4. A hinge in accordance with claim 1, the end pieces of the second hinge element comprising respective flanges, each flange having an aperture therethrough.

5. A hinge in accordance with claim 1, the second end piece of the second hinge element bearing on a further coupling element received within the opposite end of the cylindrical housing to the first coupling element and the second end piece being rotatable relative to the further coupling element.

6. A hinge in accordance with claim 5, the further coupling element including a further engagement surface arranged to engage with a corresponding further engagement surface within the cylindrical housing in the first hinge element, the further coupling element being moveable against the bias of the biasing means to disengage the further engagement surface whereby the orientation of the further engagement surface relative to the cylindrical housing may be changed in order to change the bias applied by the biasing means between the first and second hinge elements.

* * * * *

UNITED STATES PATENT AND TRADEMARK OFFICE

CERTIFICATE OF CORRECTION

PATENT NO. : 5,584,100
APPLICATION NO. : 08/190024
DATED : December 17, 1996
INVENTOR(S) : David Doyle, Neil Dunne and Mark Cumming It is certified that error appears in the above-identified patent and that said Letters Patent is hereby corrected as shown below:

Column 6, line 23, insert --rotation-- after "relative."

Signed and Sealed this

Fourteenth Day of August, 2007

JON W. DUDAS
*Director of the United States Patent and Trademark Office*

US005584100C1

(12) EX PARTE REEXAMINATION CERTIFICATE (8331st)

United States Patent
Doyle et al.

(10) Number: US 5,584,100 C1
(45) Certificate Issued: Jun. 21, 2011

(54) HINGE

(75) Inventors: David Doyle, Neutral Bay (AU); Neil Dunne, Cammeray (AU); Mark Cumming, Niagara Park (AU)

(73) Assignee: D & D Group Ltd Pty, Frenchs Forest (AU)

Reexamination Request:
No. 90/011,013, May 26, 2010

Reexamination Certificate for:

| | |
|---|---|
| Patent No.: | **5,584,100** |
| Issued: | **Dec. 17, 1996** |
| Appl. No.: | **08/190,024** |
| Filed: | **Jan. 28, 1994** |

Certificate of Correction issued Aug. 14, 2007.

(22) PCT Filed: Jul. 29, 1992

(86) PCT No.: PCT/AU92/00392

§ 371 (c)(1),
(2), (4) Date: Jan. 28, 1994

(87) PCT Pub. No.: WO93/03249

PCT Pub. Date: Feb. 18, 1993

(30) Foreign Application Priority Data

Jul. 29, 1991 (AU) ..... PK7474

(51) Int. Cl.
*E05F 1/08* (2006.01)

(52) U.S. Cl. ..... 16/301; 16/300; 16/299

(58) Field of Classification Search ..... 16/301
See application file for complete search history.

(56) References Cited

U.S. PATENT DOCUMENTS

| | | | | | |
|---|---|---|---|---|---|
| 438,115 | A | * | 10/1890 | Seely | 16/298 |
| 3,825,973 | A | * | 7/1974 | Gwozdz | 16/300 |
| 3,965,533 | A | * | 6/1976 | Frohlich | 16/300 |
| 3,978,551 | A | * | 9/1976 | Mochizuki | 16/301 |

* cited by examiner

*Primary Examiner*—Aaron J. Lewis

(57) ABSTRACT

The hinge comprises a first hinge member (11) and a second hinge member (12). The first hinge member comprises a cylindrical housing (16) having first and second open ends (17 and 18 respectively). The cylindrical housing (16) is located between flange members (26 and 27) of the second hinge member (12). A torsion spring (20) is provided inside the cylindrical housing (16) and one end (21) fits into a recess (22) at end (18) of the cylindrical housing (16) and the other end fits into a recess (36) in a coupling element (30) which is located at the other end (17) of the cylindrical housing (16). The coupling element (30) has a hexagonal engagement surface (39) which engages a matching engagement surface in flange (27). By depressing the coupling element (30) so that it is no longer in engagement with flange member (27), the coupling element (30) can be turned so that its hexagonal external surface (39) is in a different orientation with respect to the matching hexagonal surface of the flange (27), when pressure on the coupling element is released.

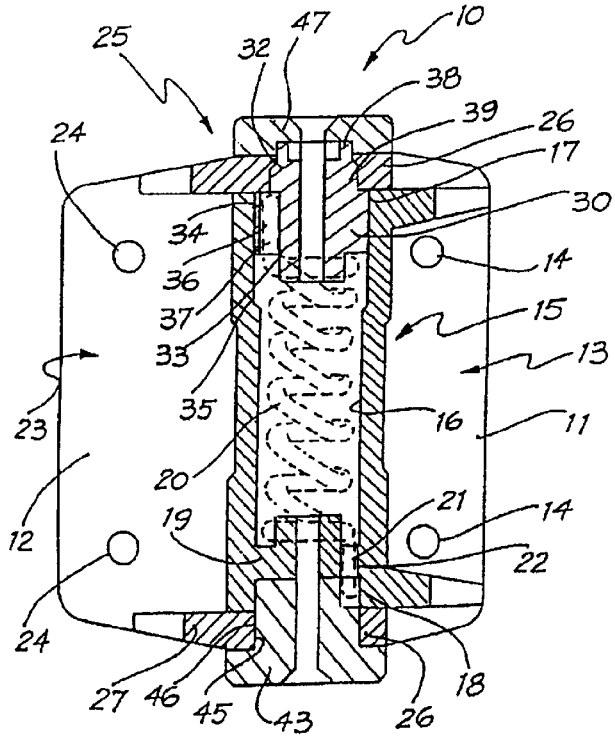

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-6, dependent on an amended claim, are determined to be patentable.

New claims 7-9 are added and determined to be patentable.

1. A hinge, comprising a first hinge element including a hollow cylindrical housing having longitudinal central axis and a hinge body having means for securing said first hinge element to a structure, a second hinge element including first and second spaced apart end pieces receiving the cylindrical housing of the first hinge element therebetween, and a hinge body portion arranged to be secured to a second structure, biasing means being located within the cylindrical housing and coupling the first hinge element to a coupling element, said coupling element having a first portion received within one end of the cylindrical housing and having a cylindrical bearing surface bearing against an inner wall of the cylindrical housing, whereby the biasing means is arranged to restrain relative rotation of the coupling element with respect to the first hinge element about said central axis, the coupling element further including a second portion *disposed axially outwardly from the first portion and* having a first engagement surface means being received within an *axially aligned* aperture provided in the first end piece of the second hinge element, said aperture having a correspondingly shaped mating engagement surface means for preventing relative *rotation* between said second hinge element and said coupling element, *said second portion further including at least one outwardly facing shoulder surface disposed between the bearing surface and the first engagement surface means,* the biasing means also resiliently biasing the coupling element in a direction axially outwardly of the cylindrical housing along said central axis urging the *at least one shoulder surface of the* second portion to engage with the aperture of the first end piece so that when the second hinge element is pivoted with respect to the first hinge element the coupling element rotates with the second hinge element and the bearing surface of the first portion rotates against the inner wall of the cylindrical housing.

*7. A hinge in accordance with claim 2, wherein the coupling element further comprises an outer end which locates within said aperture of the fist end piece of the second hinge element to allow disengagement of the engagement surface means, the outer end incorporating a driver slot to receive a driver to move the coupling element axially inwardly to allow for disengagement of the engagement surface means, to rotate the engagement surface means relative to each other and subsequently release the coupling element to cause the engagement surface means to re-engage in a new relative orientation.*

*8. A hinge in accordance with claim 1, wherein the first hinge element, the second hinge element, and the coupling element are formed from a plastic material.*

*9. A hinge, comprising a first hinge element formed from a plastic material including a hollow cylindrical housing having longitudinal central axis and a hinge body having means for securing said first hinge element to a structure, a second hinge element formed from a plastic material including first and second spaced apart end pieces receiving the cylindrical housing of the hinge element therebetween, and a hinge body portion arranged to be secured to a second structure, biasing means being located within the cylindrical housing and coupling the first hinge element to a coupling element formed from a plastic material, said coupling element having a first portion received within one end of the cylindrical housing and having a cylindrical bearing surface bearing against an inner wall of the cylindrical housing, whereby the biasing means is arranged to restrain relative rotation of the coupling element in respect to the first hinge element about said central axis, the coupling element further including a second portion having a first engagement surface means being received within an aperture provided in the first end piece of the second hinge element, said aperture extending along the central axis and having a correpondingly shaped mating engagement surface means for preventing relative rotation between said second hinge element and said coupling element, the biasing means also resiliently biasing the coupling element in a direction axially outwardly of the cylindrical housing along said central axis urging the second portion to engage with the aperture of the first end piece so that when the second hinge element is pivoted with respect to the first hinge element the coupling element rotates with the second hinge element and the bearing surface of the first portion rotates against the inner wall of the cylindrical housing, wherein said second portion of the coupling element further comprises an outer end incorporating a driver slot to receive a driver to move said second portion axially inwardly to allow for disengagement of the engagement surface means and rotation, and subsequent reengagement in a new relative orientation.*

* * * * *